US011331710B2

(12) United States Patent
Hielscher et al.

(10) Patent No.: US 11,331,710 B2
(45) Date of Patent: May 17, 2022

(54) METHOD FOR PRODUCING A MOTOR VEHICLE COMPONENT WITH AT LEAST TWO REGIONS OF DIFFERENT STRENGTHS

(71) Applicants: BENTELER AUTOMOBILTECHNIK GMBH, Paderborn (DE); BENTELER MASCHINENBAU GMBH, Bielefeld (DE)

(72) Inventors: Christian Hielscher, Delbrueck (DE); Simon Werneke, Bueren (DE); Stefan Horn, Bad Emstal (DE); Borek Dvorak, Jablonec nad Nisou (CZ); Radovan Kout, Liberec (CZ); Martin Schaele, Holzwickede (DE)

(73) Assignee: BENTELER AUTOMOBILTECHNIK GMBH, Paderborn (DE)

( * ) Notice: Subject to any disclaimer, the term of this patent is extended or adjusted under 35 U.S.C. 154(b) by 202 days.

(21) Appl. No.: 16/080,096

(22) PCT Filed: Feb. 23, 2017

(86) PCT No.: PCT/EP2017/054231

§ 371 (c)(1),
(2) Date: Aug. 27, 2018

(87) PCT Pub. No.: WO2017/144612

PCT Pub. Date: Aug. 31, 2017

(65) Prior Publication Data

US 2019/0054513 A1 Feb. 21, 2019

(30) Foreign Application Priority Data

Feb. 25, 2016 (EP) ..... 16157417

(51) Int. Cl.
*B21D 22/02* (2006.01)
*B21D 35/00* (2006.01)
(Continued)

(52) U.S. Cl.
CPC ..... *B21D 22/022* (2013.01); *B21D 22/208* (2013.01); *B21D 35/006* (2013.01);
(Continued)

(58) Field of Classification Search
USPC ..... 148/639, 530
See application file for complete search history.

(56) References Cited

U.S. PATENT DOCUMENTS

2010/0300584 A1* 12/2010 Buschsieweke ..... F27B 9/028 148/530
2011/0283851 A1* 11/2011 Overrath ..... B21D 22/00 83/15

(Continued)

FOREIGN PATENT DOCUMENTS

CN 101796202 8/2010
CN 102191362 9/2011

(Continued)

OTHER PUBLICATIONS

Roy Elliot, Cast Iron Technology, 1988, Elsevier, Chapter 4—Solid state transformations (Year: 1988).*

(Continued)

*Primary Examiner* — Jessica Cahill
*Assistant Examiner* — Mohammed S. Alawadi
(74) *Attorney, Agent, or Firm* — Jacobson Holman PLLC

(57) ABSTRACT

A method for producing a motor vehicle component with at least two regions of different strengths and a protective layer, consisting of the following process steps: —providing precoated blanks made of a steel alloy, which can be hardened, —homogeneously heating to a heating temperature, which is at least greater than or equal to the AC1 temperature, preferably greater than or equal to the AC3 temperature, —holding the heating temperature, so that the precoating alloys with the blank, —homogeneously intercooling the alloyed blank to an intercooling temperature between 450 deg. C. and 700 deg. C., partially heating the (Continued)

blank from the intercooling temperature to at least the AC3 temperature in regions of the first type and holding regions of the second type at substantially intercooling temperature, —hot forming and press hardening the partially tempered blank so as to form the motor vehicle component, wherein a tensile strength of greater than 1400 MPa is produced in regions of the first type, a tensile strength of less than 1050 MPa is produced in regions of the second type, and a transition region is produced between said regions.

11 Claims, 4 Drawing Sheets

(51) Int. Cl.

| | |
|---|---|
| ***B21D 37/16*** | (2006.01) |
| ***C21D 1/673*** | (2006.01) |
| ***B21D 22/20*** | (2006.01) |
| ***B21D 53/88*** | (2006.01) |
| ***C21D 1/20*** | (2006.01) |
| ***C21D 9/00*** | (2006.01) |
| ***C21D 11/00*** | (2006.01) |

(52) U.S. Cl.
CPC ..... *B21D 37/16* (2013.01); *C21D 1/673* (2013.01); *B21D 22/201* (2013.01); *B21D 53/88* (2013.01); *C21D 1/20* (2013.01)

(56) References Cited

U.S. PATENT DOCUMENTS

2014/0124104 A1* 5/2014 Trippe ..... C22C 38/06 148/566
2014/0338802 A1* 11/2014 Okita ..... C21D 1/673 148/653
2015/0147111 A1* 5/2015 Teague ..... C21D 1/673 403/271

FOREIGN PATENT DOCUMENTS

| | | | | |
|---|---|---|---|---|
| CN | 104204252 | | 12/2014 | |
| CN | 104250677 | | 12/2014 | |
| DE | 10208216 | | 3/2003 | |
| DE | 102007057855 | | 10/2008 | |
| DE | 102010004081 | | 3/2011 | |
| DE | 202012000616 | | 4/2012 | |
| DE | 102012110649 | | 11/2013 | |
| EP | 2497840 | | 9/2012 | |
| EP | 2905346 | | 8/2015 | |
| JP | 2014148726 | | 8/2014 | |
| JP | 2014148726 | A * | 8/2014 | ..... C21D 9/46 |
| WO | WO 2015/110456 | | 7/2015 | |
| WO | WO-2015110456 | A1 * | 7/2015 | ..... F27B 9/10 |

OTHER PUBLICATIONS

University of Kiel, The Iron Carbon Phase Diagram, Sep. 19, 2015, University of Kiel (Year: 2015).*
Baosteel R & D Centre, Advanced High Strength Steels in BAOSTEEL, Jun. 20, 2014, BAOSTEEL (Year: 2014).*
Thyssenkrupp, "thyssenkrupp InCar®plus—Prototyping of B-pillar (hot forming, tailored tempering)", Sep. 25, 2014, Youtube (Year: 2014).*
H. Föll, (Iron, Steel and Swords script), Aug. 25, 2015, Faculty of Engineering—Kiel—Germany, https://web.archive.org/web/20150825052218/https://www.tf.uni-kiel.de/matwis/amat/iss/kap_8/illustr/s8_4_1.html (Year: 2015).*
Paul M. Unterweiser et al., Heat Treater's Guide: Standard Practices and Procedures for Steel, 1995, 2nd Edition, p. 19 (Year: 1995).*

* cited by examiner

METHOD FOR PRODUCING A MOTOR VEHICLE COMPONENT WITH AT LEAST TWO REGIONS OF DIFFERENT STRENGTHS

BACKGROUND OF THE INVENTION

The present invention relates to a method for producing a motor vehicle component with at least two regions of different strengths and a protective layer.

From the prior art it is known to produce motor vehicle components by means of sheet metal forming. On the one hand, the sheet metal components comprising the exterior skin, for example, an engine hood or a roof skin, are produced. In the case of a monocoque body, however, the structural components of the motor vehicle are also produced. These structural components are, in particular, the motor vehicle pillars, roof rails, sills, cross members or longitudinal members as well as other structural components built into the body of the motor vehicle.

In the wake of the increased safety requirements for the motor vehicle body itself, as well as the statutory requirements for lower fuel consumption and lower CO2 emission, the hot forming and press hardening technology, known from the prior art, has become well established. For this purpose sheet metal components made of a steel alloy, which can be hardened, are first heated to a temperature above AC3, so that the material structure austenitizes. In this warm state the blank is then formed and, upon completion of the forming, is cooled so quickly that the material structure is hardened. In particular, martensite is formed.

As a result, it is possible to produce components having thinner wall thicknesses, an aspect that reduces the weight of the component, but at the same time having at least constant or higher strength.

Furthermore, it is known from the document DE 102 08 216 C1 to produce components with regions of different strengths as early as during the press forming process.

However, the components that are made of a steel alloy, which can be hardened, are also vulnerable to corrosion, for which reason it is also known from the prior art to provide hot formed and press hardened components with an anti-corrosion layer, also called protective layer or coating.

BRIEF DESCRIPTION OF THE INVENTION

The object of the present invention is to provide a way to produce in a cost effective manner motor vehicle components, which exhibit anti-corrosion protection and have in a selective manner sharply defined regions of different strengths.

The inventive method for producing a motor vehicle component with at least two regions of different strengths and an anti-corrosion layer is characterized by the following process steps of:

- providing precoated blanks, in particular, precut blanks, made of a steel alloy, which can be hardened,
- homogeneously heating to a heating temperature, which is at least greater than or equal to the AC1 temperature, preferably greater than or equal to the AC3 temperature,
- holding the heating temperature, so that the precoating alloys with the blank,
- homogeneously intercooling the alloyed blank to an intercooling temperature between 450 deg. C. and 700 deg. C., but at least less than the heating temperature and optionally holding the intercooling temperature for a period of time,
- partially heating the blank from the intercooling temperature+/−50 deg. C. to at least the AC3 temperature in regions of the first type and holding regions of the second type at substantially intercooling temperature+/−50 deg. C.,
- hot forming and press hardening the partially tempered blank so as to form the motor vehicle component, wherein a tensile strength of greater than 1400 MPa is produced in regions of the first type, a tensile strength of less than 1050 MPa is produced in regions of the second type, and a transition region with a width of less than 50 mm is produced between said regions.

Thus, the first step of the method is to provide a precoated starting material made of a steel alloy that can be hardened. In this case said hardenable steel alloy may be a steel material, which is unwound from a coil and already formed into blanks, or else directly precut blanks. In this context a precut blank has approximately a trimming, which is close to the final contour and which the component is supposed to have after hot forming.

This starting material is precoated. In this case it is, in particular, an aluminum silicon coating. The steel alloy that can be hardened is preferably a boron-manganese steel.

Then at this point it is provided that the starting material is heated to a heating temperature that is greater than or equal to the AC1 temperature, preferably greater than or equal to the AC3 temperature of the iron carbon diagram of the steel alloy that can be hardened. Furthermore, this heating temperature is preferably maintained for a period of time, in particular, for 90 seconds to 300 seconds. In this case an alloying of the precoating with the blank takes place. This is also referred to as diffusing the precoating into the surface of the blank. The coating has preferably a layer thickness between 20 μm and 40 μm. In particular, a distinct intermetallic phase forms. The homogeneous heating to the heating temperature is carried out, in particular, in a continuous furnace.

Once the heating temperature has been reached and, in particular, the holding phase of the heating temperature has been completed, a homogeneous intercooling of the alloyed blank with the precoating to an intercooling temperature takes place. The intercooling temperature is preferably between 450 deg. C. and 700 deg. C., but it is at least less than the heating temperature and, thus, in particular, preferably less than AC1. Preferably the intercooling temperature+/−50 deg. C. is also held for a holding time. Due to the intercooling and, in particular, due to the temperature range of the intercooling, it is possible to produce one or more material structures in a targeted manner. If the intercooling temperature is selected at approximately 500 deg. C., then the material structure is transformed primarily into bainite, which has a tensile strength of 750 MPa to 1050 MPa after quench hardening. If the intercooling temperature is selected at approximately 600 deg. C., then a predominantly ferritic/pearlitic microstructure, having a tensile strength of approximately 500 MPa up to 750 MPa, forms after quench hardening. For example, in order to produce a bainitic material structure, the blank is cooled to an intercooling temperature of approximately 500 deg. C. at a cooling rate between 3 to 15 deg. C. per second. The subsequent holding time is preferably 30 seconds to 90 seconds. In order to obtain a ferritic/pearlitic material structure, the blank is cooled to a temperature of approximately 600 deg. C. at a cooling rate of 3 to 15 deg. C. per second; and this intercooling temperature is also held for a period of 30 seconds to 90 seconds.

In order for regions of the motor vehicle component to exhibit now different strengths and, in particular, in order for some regions to exhibit high strength or ultra high strength properties with a tensile strength of greater than 1300 MPa, in particular, greater than 1400 MPa, more preferably greater than 1550 MPa, the homogeneously intercooled and alloyed blank is partially heated from the intercooling temperature+/−50 deg. C. to at least the AC3 temperature in regions of the first type and, thus, in certain regions. The remaining regions are called regions of the second type, which are held at substantially the intercooling temperature+/−50 deg. The heating of the regions of the first type to at least the AC3 temperature, preferably to 930 deg. C. to 980 deg. C., is carried out preferably in such a way that the regions of the first type austenitize completely. If this heating of the regions of the first type is carried out to at least the AC3 temperature, then the blank, which is partially tempered in different ways in regions, is transferred into a hot forming and press hardening tool, hot formed in this tempered state and then press hardened. In this way a tensile strength of greater than 1400 MPa, preferably greater than 1550 MPa, is produced in the regions of the first type, and a tensile strength Rm of less than 1050 MPa is produced in the regions of the second type.

According to the invention, it is also provided that a transition region between the regions of the first type and second type has a width of less than 50 mm. In particular, this width can be achieved by carrying out the partial heating of the regions of the first type to at least the AC3 temperature in a particularly short time, in particular, at a heating rate of greater than 30 deg. C. per second. The time for the heating is preferably less than 20 seconds, in particular, less than 15 seconds, more preferably less than 10 seconds. The heat conduction, occurring in the blank, from the regions of the first type to regions of the second type takes place only to a small degree on account of the brevity of the time, so that a sharply defined transition region is achieved with the subsequent hot forming and press hardening. The cycle time for the hot forming and press hardening is preferably about 10 seconds to 20 seconds, in particular, 15 seconds. Furthermore, in particular, a relatively short transfer time between completion of the intercooling or, more specifically, completion of the holding time of the intercooling and the hot forming and press hardening tool is realized. Preferably 2 seconds to 15 seconds are provided as the transfer time.

Furthermore, it is particularly preferred that the homogeneous heating to the heating temperature be carried out in a continuous furnace. For this purpose the continuous furnace has preferably a first zone, in order to reach and to hold the heating temperature, so that the precoating alloys. The continuous furnace may have optionally partial zones that are arranged one behind the other in the direction of passage. For example, a first zone may have an excess temperature that is significantly greater than the AC3 temperature, so that the heating temperature is reached quickly. For example, the excess temperature may be greater than 1,000 deg. C., in particular, greater than 1,100 deg. C., preferably greater than 1,200 deg C. This first zone is then followed in the direction of transport by a second temperature zone for alloying the coating. The temperature in the second temperature zone is preferably AC3, or just above the AC3 temperature, or, more specifically, +/−30 deg. C., so that the coating alloys, and the blank austenitizes completely.

This second zone can then be followed by a third zone for targeted homogeneous cooling in the direction of transport, in particular, to a temperature between 450 deg. C. and 700 deg. C.

The zones are preferably separated from one another by thermal release agents.

Optionally, in addition or as an alternative, the zones are tempered by a plurality of induction devices, which are arranged one behind the other and/or one above the other in the direction of passage or are partially overlapping. The continuous furnace can be operated in its basic mode as a burner furnace with an internal furnace atmosphere or temperature. Then the induction devices additionally heat the zones to higher temperatures at least locally.

The homogeneous intercooling to the intercooling temperature and, if desired, the optional holding of the intercooling temperature are also carried out preferably in a continuous furnace. This continuous furnace for the intercooling is designed preferably as a continuous furnace module and, in particular, is connected directly to the continuous furnace of the heating to the heating temperature. As an alternative, the intercooling can also be carried out in a chamber furnace. Furthermore, as an alternative, it would be possible to use a separate cooling station. As a third variant, it is also possible to cool in air. Air cooling can be carried out as a passive intercooling in air. In particular, in the case of a passive intercooling in air, an active holding phase of the intercooling temperature is then carried out. Active means using a heating means. This active holding phase in turn can be carried out, for example, in a chamber furnace, a multi-level furnace or even a buffer furnace. Furthermore, a continuous furnace module is used for the entire homogeneous heating and homogeneous intercooling, wherein a cooling station or cooling plates are integrated in the continuous furnace module, in order to carry out the intercooling.

As a result, the method of the present invention can be used to produce, in particular, structural components for motor vehicles, where said structural components are supposed to have small-area, strip-like and/or island-like soft regions, thus, regions of the second type. These regions may be, for example, trigger strips or side wall islands, so that specific predetermined deformation points are deformed first in the event of a vehicle crash. Coupling points, in particular, coupling flanges of the components for coupling two motor vehicle components to each other may be formed with regions of the second type, thus, soft regions, so that in the event of a motor vehicle crash and a deformation the coupling points in these regions are prevented from being torn off, and the susceptibility to fracture along subsequent joints is reduced.

Furthermore, the method of the present invention makes it possible to set a width of the transition region of less than 40 mm, in particular, less than 30 mm and more preferably less than 25 mm. As a result, it is possible to achieve very sharply defined regions of different strengths.

In this respect the regions of the second type, in particular, the soft regions, are formed so as to cover or to occupy only a small area, but preferably based on the total area of the motor vehicle component. The predominant part of the motor vehicle component should have a hardened material structure, that is, regions of the first type. Preferably more than 70%, in particular, more than 80% and more preferably more than 90% of the motor vehicle component comprises regions of the first type.

Furthermore, the intercooling to the intercooling temperature can be carried out, in particular, preferably in multiple stages and, thus, at least in two stages. A first stage of the intercooling has a higher cooling rate than a second stage with a lower cooling rate. This means that the temperature decreases more in the first stage of the intercooling. In the second stage of the intercooling, less temperature is removed over a longer period of time. Then the at least two-stage intercooling can be followed in turn by a holding phase at the intercooling temperature.

Depending on the implementation of the intercooling, a predominantly bainitic microstructure or a predominantly ferritic/pearlitic microstructure is produced in this way. However, it is also possible to produce with the intercooling a mixed structure of ferrite, pearlite and bainite.

Following the intercooling, the partial heating is then carried out, in particular, by contact heating the regions of the first type. At the same time the regions of the second type are held, in particular, at substantially the intercooling temperature. Partial heating takes place, in particular, preferably by contact heating. For this purpose, contact plates are placed on the surface of the alloyed blank. Conduction, i.e., thermal conduction from the contact plate into the blank takes place. For this purpose the contact plate has preferably a temperature that is greater than or equal to the AC3 temperature. The contact plate itself is heated by induction, by heat radiation, in particular, by burner heating. Also, a heating means, for example, a heating cartridge or heating wire, can be assigned to the contact plate. However, it is also possible that the contact plate itself is designed as an electrical resistance heater. By applying an electrical voltage to the contact plate, the contact plate heats itself. If the contact plate is placed on the blank, then the heat is conducted from the contact plate into the blank and, in particular, at least into the austenitizing regions of the first type.

As an alternative, it is possible for the partial heating to be carried out in a furnace having at least two zones. It is also possible to integrate cooling plates or tempering plates into a furnace or to place them on the blank, so that the cooling plates hold the regions of the second type at the intercooling temperature, and regions of the first type are heated to a temperature of greater than or equal to AC3 in the furnace. The furnace can be designed as a continuous furnace, but also as a chamber furnace, a multi-level furnace or even a buffer furnace.

As an alternative, it is possible in turn that the regions of the first type are heated directly by means of laser radiation. This arrangement is particularly useful when particularly extensive regions of the second type, which are, therefore, not to be heated to above AC3, are provided.

Thus, the method of the present invention makes it possible, in particular, to set a tensile strength between 750 MPa and 1050 MPa in the softer regions, i.e., regions of the second type, an aspect that corresponds to a bainitic microstructure with a martensitic component. Furthermore, it is possible to set in the softer regions a tensile strength between 600 MPa and 750 MPa, which corresponds to a ferrite/pearlitic microstructure proportions.

As a result, it is possible to produce, in particular, motor vehicle components as structural components. They are preferably motor vehicle pillars, even more preferably A-pillars or B-pillars. However, it is also possible to produce longitudinal members. Furthermore, rails, in particular, roof rails or even sills can be produced. However, body components can also be produced with the method of the present invention. In particular, coupling flanges, predetermined deformation points, coupling regions, hole edges, trigger strips and/or side wall islands are formed as regions of the second type, i.e., softer regions.

It is particularly preferred to use a multi-fold falling tool as the hot forming and press hardening tool. In particular, a two-fold falling or four-fold falling tool. This means that during one movement two components are formed simultaneously; and, after completion of the forming, the two components are also press hardened simultaneously. In the case of a four-fold falling tool, four blanks are formed simultaneously into components during a closing movement; and all four components are subsequently press hardened.

Furthermore, it is particularly preferred that two individual temperature control stations can be used for a two-fold falling hot forming and press hardening tool. Both a cooling station for intercooling and a partial heating station for partial heating to more than AC3 may be referred to as a temperature control station. This means that two individual intercooling stations and/or two individual heating stations are used for a two-fold falling hot forming and press hardening tool. For a four-fold falling hot forming and press hardening tool, two dual falling temperature control stations can be used, i.e. two two-fold falling cooling stations and two-fold falling partial heating stations.

The temperature control stations work preferably in the press cycle of the hot forming and press hardening tool.

DETAILED DESCRIPTION OF THE INVENTION

Figure 1:
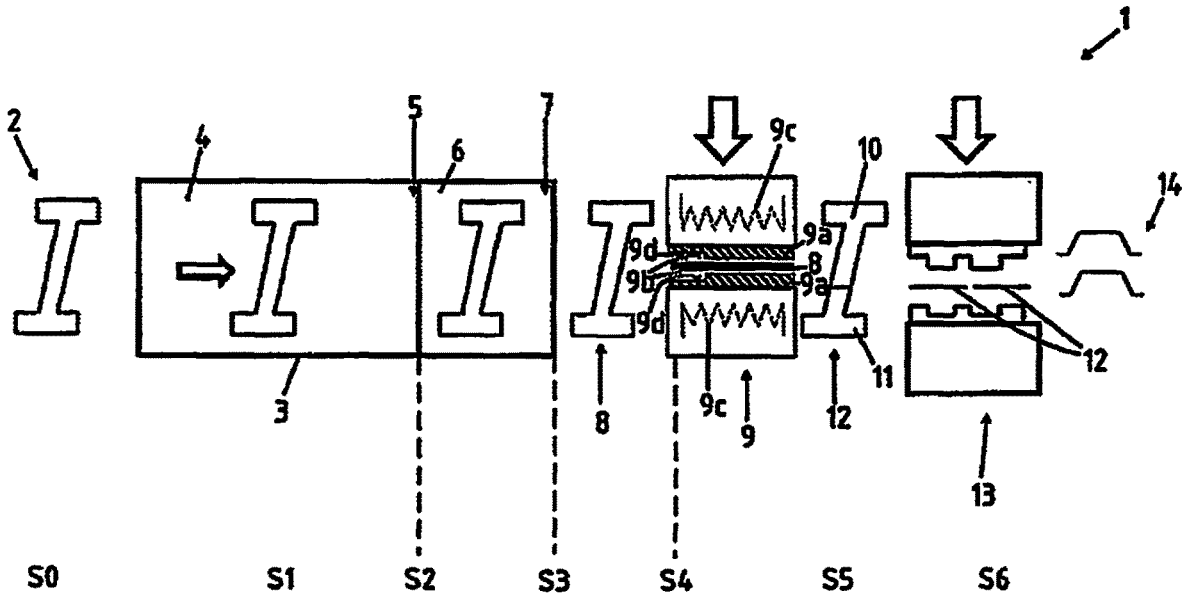
FIG. 1 an inventive hot forming line for carrying out the method with contact heating, FIG. 2 an alternative design variant of FIG. 1 with two zone furnace heating, FIG. 3 an illustration of the transition region and FIG. 4 a time-temperature diagram for carrying out the method.

The same reference numerals are used for the same or similar components in the figures, even if a repeated description is omitted for reasons of simplicity.

FIG. 1 shows an inventive hot forming line 1 for carrying out the method of the present invention. First, a blank 2 is provided in the form of a precut blank and here, in particular, for a B-pillar. This blank passes through a continuous furnace 3, wherein in a first heating zone 4 of the continuous furnace 3, the blank 2 is heated to a temperature of greater than or equal to AC1, in particular, greater than or equal to the AC3 temperature. Consequently, no later than at the end 5 of the heating zone 4 of the continuous furnace 3, the blank 2 exhibits the heating temperature. However, it can also exhibit the heating temperature before reaching the end 5 and then retains the heating temperature for the rest of the time in the heating zone 4. In this case the precoating alloys with the blank 2, so that at the end 5 of the heating zone 4 the coating completely alloys with the blank 2.

This heating zone is followed by an intercooling zone 6, in which the blank 2 is cooled to a temperature between 450 deg. C. and 700 deg. C., but at least less than the heating temperature. At the end 7 of the intercooling zone 6, the homogeneously intercooled blank 8 exhibits the intercooling temperature.

Then the homogeneously intercooled blank 8 is transferred to a contact heating station 9, wherein by closing the contact heating station 9, the blank 2 is partially heated by area contact with the contact plates 9*a* to a temperature of at least AC3 in regions of the first type 10. In regions of the second type 11, the blank 2 has a temperature that corresponds in essence to the intercooling temperature+/−50 deg. C. In particular, this temperature is reached in that the region of the first type 10 has a direct bearing contact with the contact plates 9*a* of the contact heating station 9. The regions of the second type 11 do not lie directly on the contact plates 9*a*; that is, a recess 9*d* is arranged in-between as an insulating air gap 9*b*. The contact plates 9*a* themselves are heated by a heating means 9*c*, for example, an inductor. After hot forming and press hardening, the regions of the first type 10 and the regions of the second type 11 on the tempered blank 12 should be equated with the regions of the first type 10 having high strength and the regions of the second type 11 having a comparatively lower strength.

Then the partially tempered blank 12 is transferred directly to a hot forming and press hardening tool 13 and formed by hot forming and press hardening into the motor vehicle component 14 having two regions of different strengths. Illustrated here is the production of a B-pillar, wherein, after forming, the precut blank is adapted to the final contour of the B-pillar; and, after the forming process, the B-pillar has a hat-shaped profile in the cross section. However, it is also possible to produce rails, longitudinal members as well as other structural components of the motor vehicle with the method of the present invention.

Furthermore, FIG. 1 shows a hot forming and press hardening tool 13, shown here, in particular, as a two-fold falling tool. This means that with a closing movement, two components are simultaneously formed and press hardened. It may also be preferred to use a four-fold falling tool. The contact heating station 9 can also be designed in a two-fold falling, preferably four-fold falling manner.

Figure 2:
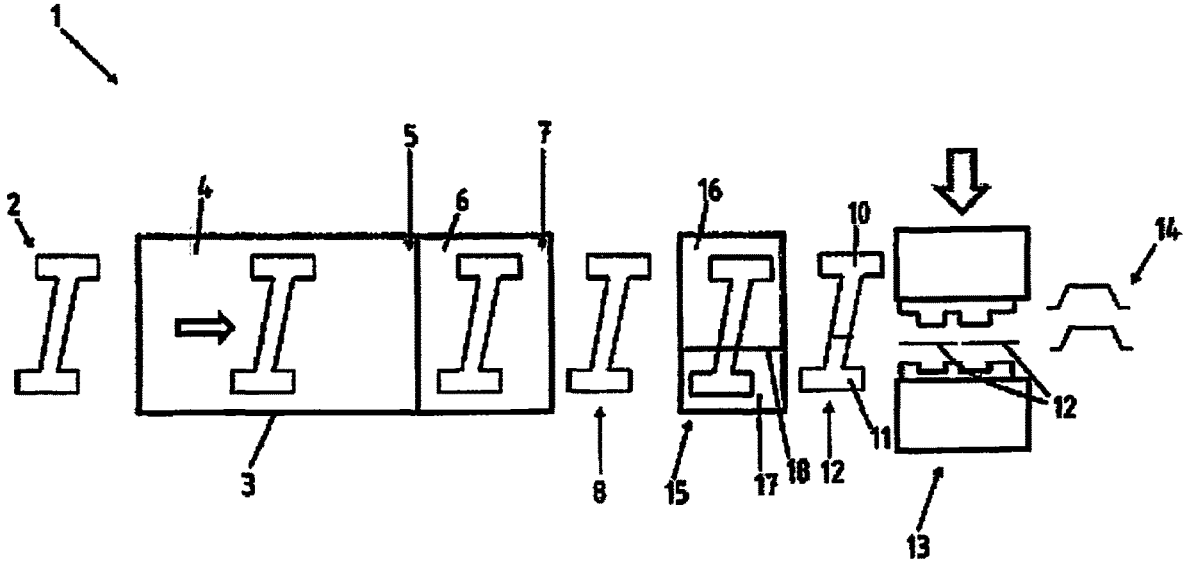

FIG. 2 shows an alternative design variant of FIG. 1, wherein in contrast to the contact heating station 9, a zone furnace 15 is used herein. The zone furnace 15 has a first zone 16 with a higher temperature, in particular, greater than or equal to the AC3 temperature and a second zone 17 with a lower temperature, with the lower temperature corresponding to the intercooling temperature of +/−50 deg. C. For example, a bulkhead 18 or the like can be arranged in the zone furnace 15, so that the blank 8, which is at an intercooling temperature, is tempered accordingly in different regions. In this case, too, a partially tempered blank 12 having a region of the first type 10 and a region of the second type 11 is produced; and this blank is subsequently hot formed and press hardened. The zone furnace 15 does not have to be a two-zone furnace; it can also be designed as a multiple zone furnace, depending on the geometric specification of the position of the regions of the first type 10 and the second type 11. The zone furnace 15 can be operated as a continuous furnace. However, it can also be designed so as to be multiple storied, in particular, for saving space as a multi-level furnace. It can also be designed as a multi-story continuous furnace. In the first zone 16 it is particularly preferred that the furnace have a significantly higher interior temperature, in particular, greater than 1,000 deg. C.

Figure 3:
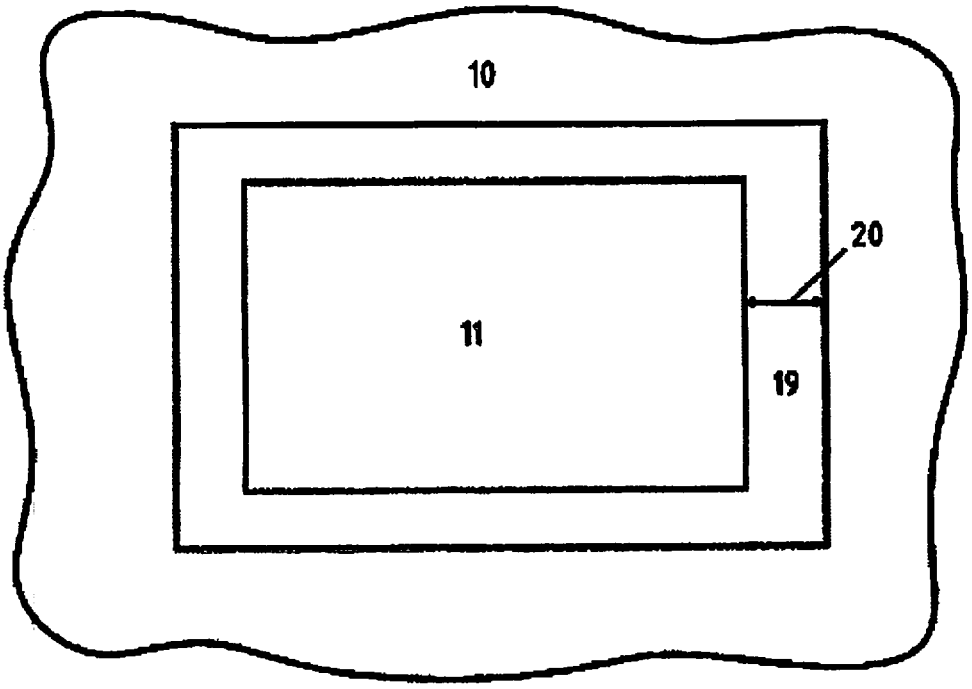

FIG. 3 shows an illustration of the regions of the first and second type 10, 11 and a transition area 19 between the two regions. The transition region 19 extends with a width between the region of the first type 10 and the region of the second type 11. The width is, according to the invention, preferably less than 50 mm. In this case the region of the second type 11 is designed as an island region or inland region. Consequently it is completely enclosed by the region of the first type 10. In accordance with the invention, the region of the first type 10 has preferably a tensile strength of greater than 1400 MPa, in particular, greater than 1500 MPa. The tensile strength should be limited to approximately 2000 MPa. If, however, it were possible to achieve greater tensile strengths by means of a steel alloy, then this would also be within the scope of this invention.

Figure 4:
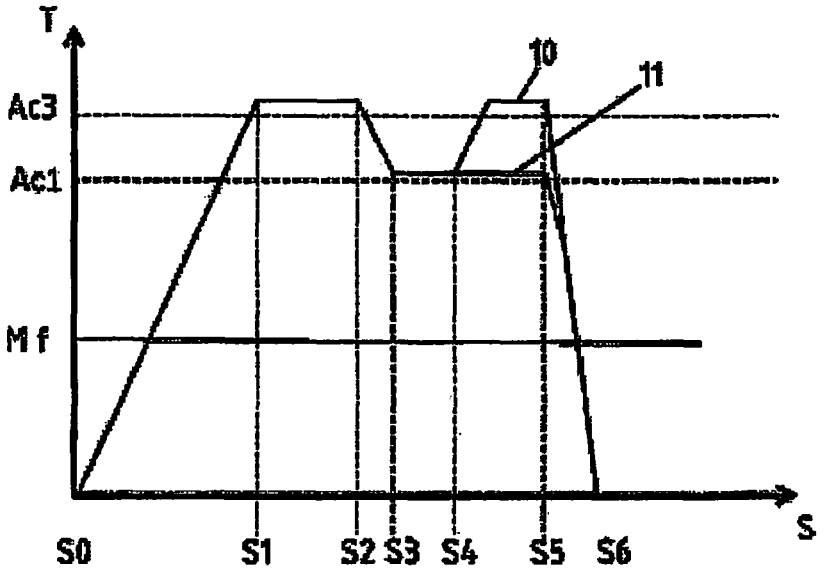

FIG. 4 shows in schematic form the sequence of the method of the present invention, wherein the temperature T, which is to be produced, is shown in degrees centigrade on the Y axis; and the time in seconds is shown on the X axis, but unfortunately not to scale. First, at the time S0 the blank 2 is provided at room temperature. Then this blank is brought into the continuous furnace 3 and heated to the heating temperature, here shown at approximately AC3, until the time S1. The heating processes, shown by way of example, can in reality be linear, progressive, digressive or in mixed forms. They are shown here by means of straight lines and not to scale only for illustrative purposes. The time for heating is about 300 to 400 seconds, in particular, 320 to 380 seconds, preferably 350 to 370 seconds and, in particular, 360 seconds. This time can also already include the holding of the heating temperature up to the time S2. At time S2 the homogeneously heated and alloyed blank 8 is transferred to the homogeneous intercooling and is cooled homogeneously to the intercooling temperature. This is carried out in a period of time preferably between 30 seconds and 200 seconds, preferably 50 seconds to 100 seconds. Thus, the homogeneously intercooled temperature leaves the intercooling station at time S3 and is passed to a partial heating station, for example, into a contact heating station 9. This is shown at time S4. The transfer time from S3 to S4 is preferably as short as possible. The heating step from intercooling temperature to partial heating temperature is shown from time S3 to S5. From S4, beginning of the partial tempering to S5, stopping the partial tempering, it usually takes less than 20 seconds, in particular, less than 15 seconds, preferably less than 10 seconds, even more preferably 8 seconds. At time S5 the partially tempered blank 12 is then transferred to the hot forming and press hardening tool 13 and is hot formed and press hardened. In so doing, the regions of the first type 10 are quenched by the heating temperature, i.e. greater than or equal to the AC3 temperature, and the regions of the second type 11 are quenched by the intercooling temperature+/−50 deg. C., shown here in the range of AC1. At time S6 the press hardening is completed, wherein the temperature of the press hardened component is between room temperature, i.e., about 20 deg. C. and 200 deg. C., upon removal from the press shop.

REFERENCE NUMERALS

1—hot forming line
2—blank
3—continuous furnace
4—heating zone with respect to 3
5—end with respect to 4
6—intercooling zone with respect to 3
7—end with respect to 6
8—homogeneously intercooled blank
9—contact heating station
9*a*—contact plate
9*b*—air gap
9*c*—heating means
9*d*—recess
10—region of the first type
11—region of the second type
12—partially tempered blank

13—hot forming and press hardening tool
14—motor vehicle component
15—zone furnace
16—first zone with respect to 15
17—second zone with respect to 15
18—bulkhead with respect to 15
19—transition region between 10 and 11
20—width with respect to 19

The invention claimed is:

1. A method for producing a motor vehicle component with at least two regions of different strengths and a protective layer, said method comprising the following process steps:

providing precoated precut blanks, made of a steel alloy, which can be hardened;

homogeneously heating to a heating temperature, which is at least greater than or equal to the AC3 temperature;

holding the heating temperature for 90 to 300 seconds, so that the precoating alloys with the blank to provide a coating having a layer thickness of between 20 μm and 40 μm;

homogeneously intercooling the alloyed blank to an intercooling temperature between 450 deg. C. and 700 deg. C. with a cooling rate of 3 to 15 K/s, holding the intercooling temperature for 30 to 90 seconds and attaining a predominantly ferritic-pearlitic or ferritic-pearlitic bainitic microstructure, whereby the homogeneously heating and intercooling is performed in one single continuous furnace with a heating station and a cooling station;

partially heating the blank in less than 20 from the intercooling temperature to at least the AC3 temperature in regions of a first type and holding regions of a second type at the intercooling temperature to form a partially tempered blank; and hot forming and press hardening the partially tempered blank so as to form the motor vehicle component, wherein a tensile strength of greater than 1400 MPa is produced in regions of the first type, a tensile strength of between 600 and 750 MPa and a ferritic-pearlitic microstructure is produced in regions of the second type, and a transition region of less than 50 mm is produced between said regions.

2. The method according to claim 1, wherein an AlSi coating is used as a precoating.

3. The method according to claim 1, wherein the homogeneous intercooling is carried out in multiple stages.

4. The method according to claim 3, wherein a first stage of the intercooling is carried out at a higher cooling rate compared to a second stage or further stages at a lower cooling rate.

5. The method, according to claim 1, wherein with the intercooling a predominantly bainitic microstructure is produced.

6. The method according to claim 1, wherein the partial heating is carried out by contact heating.

7. The method according to claim 6, wherein the contact heating is effected by contact plates or rollers.

8. The method, according to claim 1, wherein the partial heating is carried out in a furnace comprising at least two zones of different temperatures.

9. The method according to claim 1, wherein the hot forming and press hardening is carried out in a two-fold or four-fold falling hot forming and press hardening tool, and wherein a two-fold falling or four-fold falling contact heating tool is used.

10. The method according to claim 1, wherein in regions of the second type a tensile strength between 750 and 1050 MPa is produced.

11. The method according to claim 1, wherein structural components including motor vehicle pillars, longitudinal members, rails or sills, or body components are produced as a motor vehicle component.

* * * * *